United States Patent [19]

Lyon

[11] 4,291,809

[45] Sep. 29, 1981

[54] PENCIL HOLDER

[76] Inventor: Edwin J. Lyon, 787 Gascogne, St. Louis, Mo. 63141

[21] Appl. No.: 111,269

[22] Filed: Jan. 11, 1980

[51] Int. Cl.[3] ..... A47F 7/00; B43M 17/00; F41B 7/08; F41C 19/14

[52] U.S. Cl. ..... 211/69.5; 124/31

[58] Field of Search ..... 211/69.5, 69.6, 69.7, 211/69.1; 124/37, 31, 26, 27

[56] References Cited

U.S. PATENT DOCUMENTS

| | | | |
|---|---|---|---|
| 1,795,824 | 3/1931 | Bellavance | 211/69.7 |
| 2,916,013 | 12/1959 | Rhoades et al. | 211/69.5 X |
| 2,957,270 | 10/1960 | Kennamer, Jr. | 211/69.5 |
| 3,191,342 | 6/1965 | Chalmers | 124/31 X |
| 3,273,846 | 9/1966 | De Mare | 211/69.5 X |
| 3,339,536 | 9/1967 | Glass et al. | 124/37 X |
| 3,811,675 | 5/1974 | Torgon | 124/26 X |

*Primary Examiner*—Stephen J. Novosad
*Attorney, Agent, or Firm*—Cohn, Powell & Hind

[57] ABSTRACT

A pencil holder includes a body having a socket, the body including a substantially horizontal base portion. A pencil is selectively received in the body socket and engages a compression spring located longitudinally within the body socket. A hook having a hooked end portion within the base portion and a longitudinal portion extending the length of the spring within the body socket and engaging the spring to retain the spring compressed upon insertion of the pencil in the body socket. A catch block within the base portion selectively engages the hooked end portion of the hook when the spring is in a compressed state. A guide vane is located adjacent to the catch block. The guide vane has a curved end underlying the catch block. The guide vane engages the hooked end portion, and the curved end aligns the hooked end portion with the catch block when the spring is being compressed. A piston-operated plunger selectively engages the hooked end portion of the hook for disengaging the hooked end portion from the catch block to release the spring for launching the pencil. A remotely located pneumatic pump is operatively connected to the plunger by a line for pneumatically actuating the plunger when the pump is operated.

10 Claims, 5 Drawing Figures

PENCIL HOLDER

BACKGROUND OF THE INVENTION

This invention relates generally to a pencil holder, and particularly to a pencil holder which will selectively launch a pencil.

Prior pencil holders of the type which serve merely to hold the pencil. When it is desired to retrieve a pencil from the pencil holder for use, it is necessary that the user manually reach and withdraw the pencil from the pencil holder.

SUMMARY OF THE INVENTION

This pencil holder provides a means of projecting or launching a pencil to the user.

The pencil holder includes a body having a socket. A pencil is selectively received in the body socket. Resiliently compressible means engage the pencil within the body socket while locking means engage the compressible means for selectively retaining the compressible means compressed when the pencil is inserted in the body socket. Trigger means is connected to the locking means for actuating the locking means for releasing the compressible means to launch the pencil from the body socket.

In the preferred embodiment, the resiliently compressible means is a compression spring located longitudinally within the body socket.

In one aspect of the invention, the body includes a substantially horizontal base portion with the longitudinal axis of the body socket forming an acute angle with the base portion.

In another aspect of the invention the locking means includes a hook having a hooked end portion within the base portion and a longitudinal portion extending the length of the spring within the body socket and engaging the spring. A catch block within the base portion selectively engages the hook end portion of the hook when the spring is in a compressed position.

In another aspect, the locking means includes a guide vane located adjacent to the catch block, the guide vane engaging the hooked end portion when the spring is being compressed to align and engage the hooked end portion with the catch block. The guide vane includes a curved end underlying the catch block. The curved end of the guide vane engages the hooked end portion to align the hooked portion with the catch block.

In one aspect, the trigger means includes a plunger selectively engaging the hooked end portion of the hook for disengaging the hooked end portion from the catch block to release the spring for launching the pencil.

In another aspect, the trigger means includes actuating means located remotely from the base portion. The trigger means includes a piston-operated plunger, selectively engaging the locking means, located within the base portion. The actuating means includes a manually-operated pneumatic pump means, and a line operatively interconnecting the pump means and the plunger for pneumatically actuating the plunger when the pump means is operated.

Figure 1:
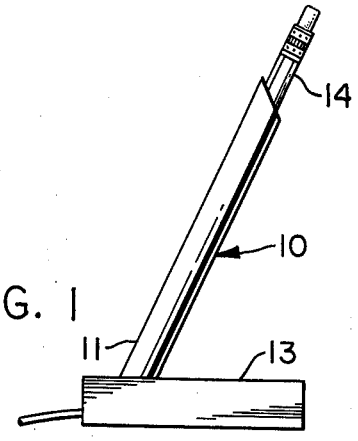
FIG. 1 is a side elevational view of the pencil holder.
Figure 2:
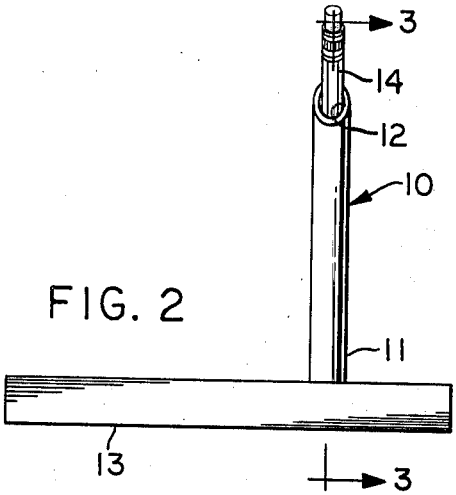
FIG. 2 is a front elevational view of the pencil holder.
Figure 3:
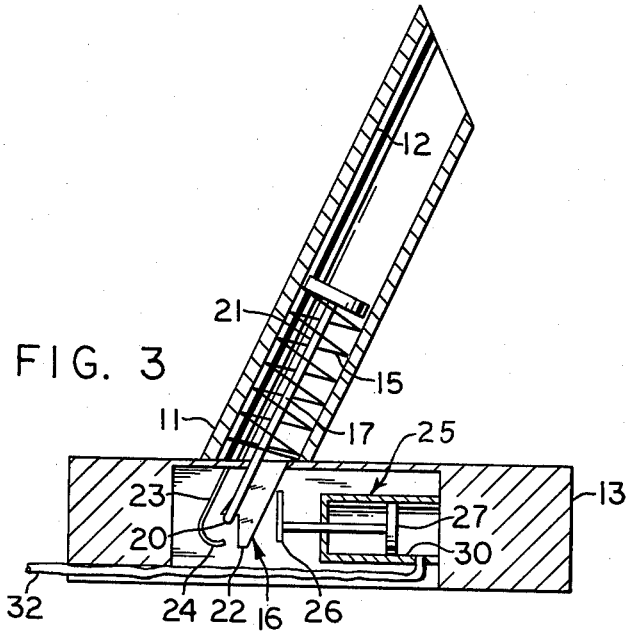
FIG. 3 is an enlarged sectional view taken on line 3—3 of FIG. 2.
Figure 4:
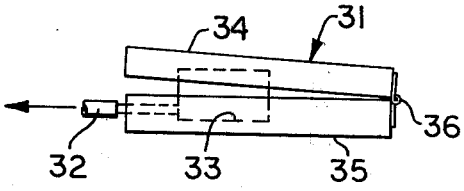
FIG. 4 is an elevational view of the pump.
Figure 5:
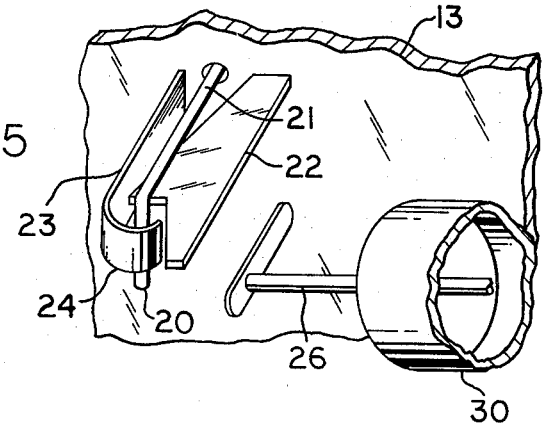
FIG. 5 is an enlarged fragmentary view partly in section, of the locking means.

DESCRIPTION OF THE PREFERRED EMBODIMENT:

Referring now by characters of reference to the drawings and first to FIGS. 1 and 3, it will be understood that the pencil holder generally indicated by numeral 10 includes a body 11 having a longitudinal socket 12. The body 11 has a substantially horizontal base portion 13 with the longitudinal axis of the body socket 12 forming an acute angle with the base portion 13.

A longitudinal projectile constituting a pencil 14 is selectively received in the body socket 12. A compression spring 15, constituting resiliently compressible means, is located within the body socket 12 and engages the pencil 14 within the body socket 12.

Locking means, indicated generally by 16, located within the body 11 engages the spring 15 for selectively retaining the spring 15 compressed upon insertion of the pencil 14 in the body socket 12. The locking means 16 includes a hook 17 having a hooked end portion 20 within the base portion 13 and a longitudinal portion 21 extending the length of the spring 15 within the body socket 12. The hook 17 engages the upper end of the spring 15.

The locking means 16 also includes a catch block 22 located within the base portion 13 of the body 11. The catch block 22 is attached to body 11 as by a snap connection thereby facilitating the replacement of the catch block 22. The catch block 22 selectively engages the hooked end portion 20 of the hook 17 and holds the spring 15 in a compressed position as shown in FIG. 3.

A guide vane 23 is located adjacent to the catch block 22 within the base portion 13. The guide vane 23 includes a curved end portion 24 which underlies the catch block 22. When the spring 15 is being compressed, the guide vane 23 engages the hooked end portion 20 of the hook 17 with the curved end portion 24 aligning the hooked end portion 20 with the catch block 22.

Trigger means, indicated generally by 25, is connected to and actuates the locking means 16 for releasing the spring 15 to launch the pencil 14 from the body socket 12. The trigger means 25 includes a plunger 26 operated by a piston 27 within a cylinder 30. The piston-operated plunger 26 is located within the base portion 13 and selectively engages the hooked end portion 20 of the hook 17 for disengaging the hooked end portion 20 from the catch block 22 to release the spring 15 for launching the pencil 14.

Actuating means includes a manually-operated pneumatic pump means 31, and a line 32 operatively interconnecting the pump means 31 and the plunger 26. The piston-operated plunger 26 is pneumatically actuated when the pump means is operated. The pump means 31 includes a bellows 33 located within upper and lower housings, 34 and 35 respectively. The housings 34 and 35 are attached by a hinge 36 on one side. The bellows 33 can be actuated as by foot pressure on the upper housing 34 to launch the pencil 14.

It is thought that the structural features and the functional advantages of this pencil holder have become fully apparent from the foregoing description of parts, but for completeness of disclosure, the operation of the device will be briefly discussed.

In operation, a pencil 14 is placed in the pencil holder 10 within the body socket 12. The pencil 14 is manually pressed into the body socket 14 against the pressure of the spring 15, thereby causing the spring 15 to be compressed and the hook 17 to slide further into the base portion 13. The hooked end portion 20 of the hook 17 slidably engages the guide vane 23 as the spring 15 is being compressed. When the hooked end portion 20 reaches the curved end portion 24 of the guide vane 23, the pencil 14 is fully inserted and can be manually released. The hooked end portion 120 then underlies the catch block 22 and the spring 15 slightly expands, causing the hooked end portion 20 to engage the catch block 22, the hook 17 engaging the top of the spring 15 and holding it in the compressed position and holding the pencil 14 in its loaded position. The pump means 31 is located remotely of the pencil holder body 11 where it can be operated to launch the pencil 14.

When it is desired to launch the pencil 14, the upper housing 34 is depressed causing the bellows 33 to force compressed air through the line 32. The compressed air from the line 32 enters the cylinder 30 and pushes the piston 27, thereby causing the plunger 26 to engage the hooked end portion 20 of the hook 17 to release the hook 17 from the catch block 22. When the hook 17 has been released, the compressed spring 15 expands rapidly causing the pencil 14 to be launched and expelled from the body socket 12.

When the pressure is removed from the bellows 33, the piston 27 and plunger 26 are retracted, and the pencil holder 10 can be reloaded with another pencil 14.

The length of the catch block 22 determines the tension of the spring 15 in its loaded position and consequently , the amount of force to be applied to the pencil 14 when it is launched. The catch block 22 can be of appropriate length to provide the desired spring tension for a given weight pencil 14.

I claim as my invention:

1. A pencil holder, comprising:

(a) a body having a socket, (b) a pencil selectively received in the body socket, (c) resiliently compressible means engaging the pencil within the body socket, (d) locking means engaging the compressible means for selectively retaining the compressible means compressed upon insertion of the pencil in the body socket, and (e) trigger means connected to and actuating the locking means for releasing the compressible means to launch the pencil from the body socket.

2. A pencil holder as defined in claim 1, in which:

(f) the resiliently compressible means is a compression spring located longitudinally within the body socket.

3. A pencil holder as defined in claim 2, in which:

(g) the body includes a base portion, and (h) the locking means includes:

1. a hook having a hooked end portion within the base portion, and a longitudinal portion extending the length of the spring within the body socket and engaging the spring, and
2. a catch block within the base portion selectively engaging the hooked end portion of the hook and holding the spring in a compressed position.

4. A pencil holder as defined in claim 2, in which:

(g) the body includes a base portion, (h) the locking means includes:

1. a hook having a hooked end portion within the base portion, and a longitudinal portion extending the length of the spring within the body socket and engaging the spring,
2. a catch block within the base portion selectively engaging the hooked end portion of the hook and holding the spring in a compressed position, and
3. a guide vane located adjacent to the catch block, the guide vane having a curved end underlying the catch block, the guide vane engaging the hooked end portion and the curved end aligning the hooked end portion with the catch block, when the spring is being compressed, and (i) the trigger means includes:

1. a piston-operated plunger located within the base portion and selectively engaging the hooked end portion of the hook for disengaging the hooked end portion from the catch block to release the spring for launching the pencil, and
2. actuating means located remotely from the base portion includes:
   i. a manually-operated pneumatic pump means, and ii. a line operatively interconnecting the pump means and the plunger for pneumatically actuating the plunger when the pump means is operated.

5. A pencil holder as defined in claim 3, in which:

(i) the locking means includes a guide vane located adjacent to the catch block, the guide vane engaging the hooked end portion when the spring is being compressed to align and engage the hooked end portion with the catch block.

6. A pencil holder as defined in claim 5, in which:

(j) the guide vane includes a curved end underlying the catch block, the curved end of the guide vane engaging and aligning the hooked end portion with the catch block.

7. A pencil holder as defined in claim 3, in which:

(i) the trigger means includes a plunger selectively engaging the hooked end portion of the hook for disengaging the hooked end portion from the catch block to release the spring for launching the pencil.

8. A pencil holder as defined in claim 1, in which:

(f) the trigger means includes actuating means located remotely from the base portion.

9. A pencil holder as defined in claim 8, in which:

(g) the trigger means includes:

1. a piston-operated plunger selectively engaging the locking means, located within the base portion, and (h) the actuating means includes:

1. a manually-operated pneumatic pump means, and
2. a line operatively interconnecting the pump means and the plunger for pneumatically actuating the plunger when the pump means is operated.

10. A pencil holder as defined in claim 1, in which:

(f) the body includes a substantially horizontal base portion, and (g) the body socket has a longitudinal axis which forms an acute angle with the base portion.

* * * * *